US009714521B1

(12) United States Patent
Aloumanis

(10) Patent No.: US 9,714,521 B1
(45) Date of Patent: Jul. 25, 2017

(54) SELF-DRAINING CANOPY

(71) Applicant: Peter Aloumanis, Boca Raton, FL (US)

(72) Inventor: Peter Aloumanis, Boca Raton, FL (US)

( * ) Notice: Subject to any disclaimer, the term of this patent is extended or adjusted under 35 U.S.C. 154(b) by 0 days.

(21) Appl. No.: 15/007,464

(22) Filed: Jan. 27, 2016

(51) Int. Cl.

| | |
|---|---|
| ***E04H 15/02*** | (2006.01) |
| ***E04H 15/26*** | (2006.01) |
| ***E04H 15/54*** | (2006.01) |
| ***E04H 15/36*** | (2006.01) |
| ***E04D 13/04*** | (2006.01) |

(52) U.S. Cl.
CPC ..... *E04H 15/02* (2013.01); *E04D 13/04* (2013.01); *E04H 15/26* (2013.01); *E04H 15/36* (2013.01); *E04H 15/54* (2013.01)

(58) Field of Classification Search
CPC ..... E04H 15/02; E04H 15/16; E04H 15/26; E04H 15/32; E04H 15/54; E04H 15/58; A01G 9/14; A01G 9/24; A01G 9/247; E04D 13/076; E04D 13/08; E04D 13/04; E04D 2013/045
USPC ..... 135/87, 94–96, 135, 147, 115, 117, 135/120.1, 905; 52/11, 13–16; 137/357; 47/17, 65.6
See application file for complete search history.

(56) References Cited

U.S. PATENT DOCUMENTS 4,527,544 A * 7/1985 Wolf ..... A01G 9/222 126/605
4,937,969 A * 7/1990 Kawabe ..... A01G 31/02 135/94
5,862,633 A * 1/1999 Van Ells ..... E03B 3/02 135/117
7,513,712 B2 * 4/2009 Hanstvedt ..... E21F 16/02 404/2
7,721,746 B2 * 5/2010 Yul ..... E04H 15/14 135/115
8,132,583 B2 * 3/2012 Mowatt, Sr. ..... E04F 10/0603 135/117
8,220,475 B2 * 7/2012 Yul ..... E04H 15/32 135/115
8,424,549 B1 * 4/2013 Goldsmith ..... E04H 15/60 135/116

(Continued)

FOREIGN PATENT DOCUMENTS

JP 2006112120 A * 4/2006

*Primary Examiner* — Winnie Yip
(74) *Attorney, Agent, or Firm* — Patents on Demand P.A.; Brian K. Buchheit; Scott M. Garrett

(57) ABSTRACT

A self-draining canopy that includes a covering, an orthogonal support structure, and a drainage system. The covering can have a substantially quadrilateral shape in a horizontal plane. The orthogonal support structure can be coupled to the covering. When erected, non-vertical elements of the orthogonal support structure that the covering rests upon can be positioned substantially orthogonally within the horizontal plane. A natural contour of the formed canopy can automatically direct environmental substances deposited upon the top surface toward the corners of the canopy where the drainage system is installed. The drainage system can transport environmental substances from the top surface of the canopy to an outlet location. Transportation of the environmental substances can be provided by the force of gravity. The drainage system can prevent the accumulation of environmental substances on the top surface of the canopy and deformation of the canopy due to such accumulations.

20 Claims, 4 Drawing Sheets

(56) References Cited

U.S. PATENT DOCUMENTS

| | | | | |
|---|---|---|---|---|
| 8,544,488 | B2 * | 10/2013 | Lin | E04H 15/44 135/158 |
| 2003/0101677 | A1 * | 6/2003 | Hewett | E04H 15/06 52/655.1 |
| 2005/0178417 | A1 * | 8/2005 | Holub | E04H 15/54 135/115 |
| 2010/0193046 | A1 * | 8/2010 | Moroder | E04D 13/08 137/357 |
| 2014/0352842 | A1 * | 12/2014 | McEvilly | E04H 15/04 141/69 |

* cited by examiner

Isometric Side View 305

Isometric Top View 330

SELF-DRAINING CANOPY

BACKGROUND

The present invention relates to the field of shelters and, more particularly, to a self-draining canopy.

Portable shelters like the "pop-up" or portable canopy 105 shown in illustration 100 of FIG. 1 are owned and used by many people to provide protection from sun and rain during outdoor activities, such as parties and bar-be-ques. The portability of the portable canopy 105 is provided by a light-weight and collapsible support structure 115 with an attached covering 110. When the support structure 115 is locked into place, the edges of the covering 110 are stretched along the sides of the support structure and the center of the covering is lifted upwards to create the canopy 105 shape. Generally, conventional canopy's establish a 45 degree (from horizontal) angle of the covering 110 in that the canopy's structural support (peaking at an apex) form an upwardly sloping 45 degree angle. The result of this arrangement is that once weight is added to the sloped covering portions, the fabric of the covering will generally deform to create a pocket (see depressed area 135 and water pool 140). This pocket traps water during raining events, which becomes standing water that runs downward in a somewhat chaotic manner. Hence, the periphery of the canopy 105 "drips" due to this run-off causing humans seeking shelter under the canopy to get abnormally soaked when entering/exiting the canopy 105. Further, when multiple canopy's are combined to increase area of protection, the edges where these canopies meet are highly subject to water run-off leaking between the joined canopies. This is an unresolved problem that has not been highly recognized in the field nor corrected, which is a recognized (by our inventors) shortcoming overcome by this disclosure.

Many support structures 115 are configured to produce a quadrilateral (e.g., square or rectangular) frame. This results in the covering 110 being formed into the shape of a square or rectangular pyramid (i.e., a square or rectangular base with triangular sides having a common vertex). The corners of the square or rectangular base typically correspond with the vertical supports or legs of the support structure, as shown in illustration 100.

When rain 130 falls on the portable canopy 105, as shown in illustration 120, the natural contour of the covering 110 directs the rain 130 towards the base of the triangular side. Over time, the rain 130 accumulates into a water pool 140 and the weight of the water pool 140 creates a depressed area 135 in the covering 110. Eliminating the water pool 140 requires a person to be able to be under the depressed area 135 and push against the depressed area 135 (i.e., return the depressed area 135 to its original contour). Over time, exposure to the weight of the water pool 140 deforms the contour of the covering 110, reducing the overall life of the canopy 105.

What is needed is a solution that allows the water pool 140 to drain off of the canopy's 105 covering 110. Such a solution would modify the natural contour of the covering 110 to utilize gravity.

BRIEF SUMMARY

One aspect of the present invention can include a self-draining canopy that includes a covering, an orthogonal support structure, and a drainage system. The covering can be made from a water-resistant material and can have a substantially quadrilateral shape in a horizontal plane. The orthogonal support structure can be coupled to the covering. The orthogonal support structure can vertically position edges of the covering at a first height and can vertically lift a center point of the covering to a second height that is higher than the first height to form a canopy. The orthogonal support structure (at a 90 degree angle) represents a modification of a conventional canopy support structure (at a 45 degree angle) described in the prior art and detailed in the background and in FIG. 1. Hence, embodiments of the disclosure modify a conventional roof support structure by rotating support members by 45 degrees (making them substantially orthogonal (+/−5 degrees). When erected, non-vertical elements of the orthogonal support structure that the covering rests upon can be positioned substantially orthogonally within the horizontal plane. A natural contour of the formed canopy can automatically direct environmental substances deposited upon the top surface toward the corners of the canopy's substantially quadrilateral shape. A drainage system can be installed near the corners of the canopy. The drainage system can transport environmental substances from the top surface of the canopy to an outlet location. Transportation of the environmental substances can be provided by the force of gravity. The drainage system can prevent the accumulation of environmental substances on the top surface of the canopy and deformation of the canopy due to such accumulations.

Thus, unlike conventional canopy structures, the disclosed improved canopy ensures no uncontrolled depressed area 135 exists where water is able to pool (140). Instead, water run-off is directed to a drain (e.g., 410) built onto the top portion of the canopy structure, which mitigates the formation of depressed areas due to water pooling on a top of a canopy. Water (that would otherwise pool) is directed and controlled using an interior channel (e.g., 417) linked to the top drain (e.g., 410), so that humans entering/exiting the canopy do not get wet from water run-off. Further, the drain that prevents a creation of a depressed area on a top of the canopy due to water weight extends the life of the canopy itself by minimizing the weight-induced distortions of conventional designs.

Another aspect of the present invention can include a drainage system for a canopy having an orthogonal support structure (e.g., rotated approximately 45 degrees from a conventional canopy structure) that is comprised of multiple drainage apparatuses. The drainage apparatuses can transport environmental substances from a top surface of the canopy to an outlet location. Transportation of the environmental substances can be provided by a force of gravity in conjunction with a natural contour of the canopy. The natural contour of the canopy can be created by the orthogonal support structure and can automatically direct environmental substances deposited upon the top surface toward the drainage apparatuses. Each drainage apparatus can prevent the accumulation of the environmental substances on the top surface of the canopy and deformation of the canopy due to such accumulations. Each drainage apparatus can include a drain and a transport element. The drain can establish one or more apertures through the canopy to allow passage of the environmental substances. The transport element can be connected to the drain and can permit the environmental substances to move from the drain to the outlet location through an enclosed space.

Yet another aspect of the present invention can include a method that begins by supporting a canopy with an orthogonal support structure. The non-vertical elements of the orthogonal support structure that the canopy rests upon can be positioned substantially orthogonally within a horizontal plane. Upon exposure of the canopy to rain, rain that has fallen on a top surface of the canopy can be directed toward an installed drainage system using a natural contour of the canopy in conjunction with a force of gravity. The natural contour of the canopy can be induced by the orthogonal support structure. The rain can then be transported from the top surface of the canopy to an outlet location by the drainage system. The outlet location can be proximate to ground level. The drainage system can introduce one or more apertures through the canopy. Further, the drainage system can prevent the accumulation of the rain on the top surface of the canopy and deformation of the canopy due to a weight of such accumulations.

DETAILED DESCRIPTION

Figure 1:
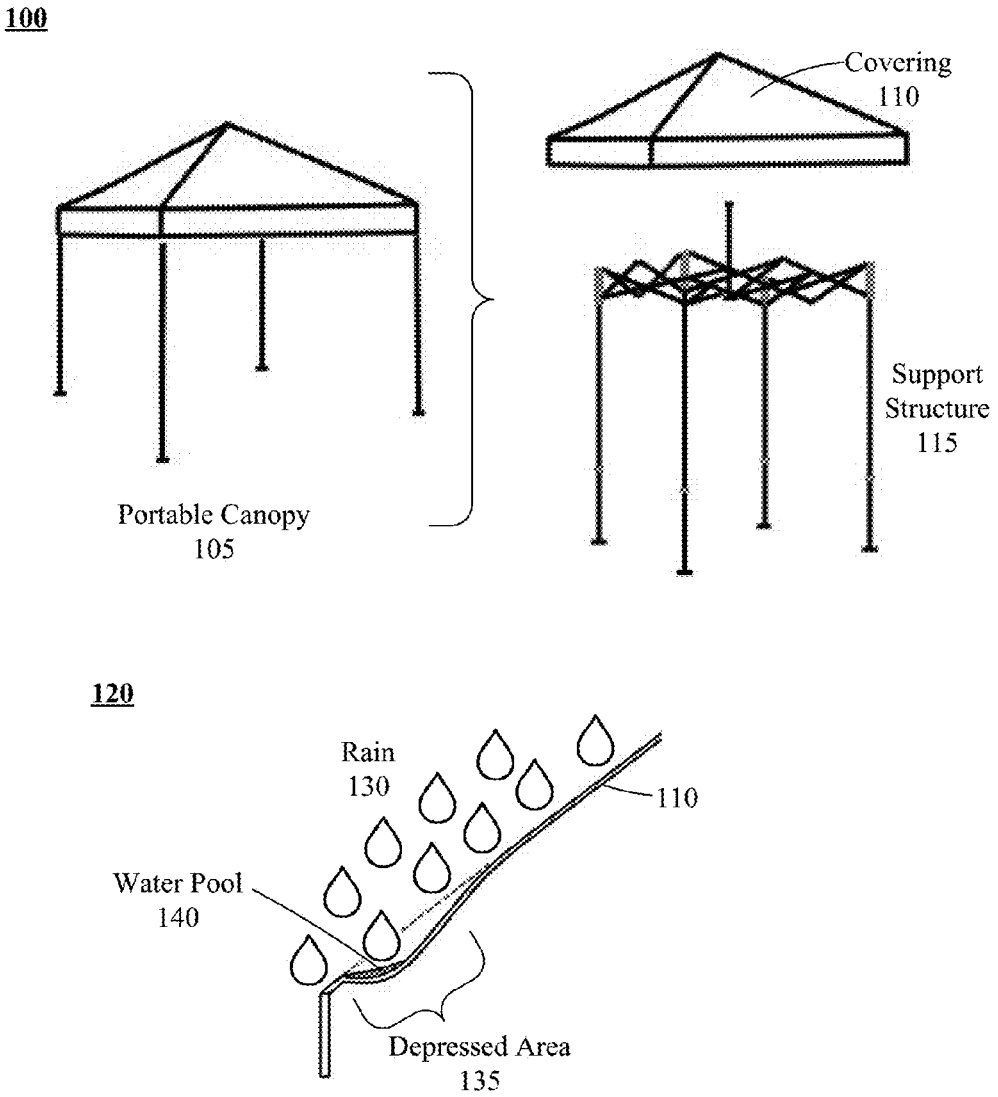
FIG. 1 (PRIOR ART)
FIG. 1 (Prior Art) illustrates the structure of a conventional portable canopy and how this configuration permits water to pool on the canopy.

As will be appreciated by one skilled in the art, aspects of the present invention can be a system and/or method that embodies a solution for draining water and other environmental substances from the top surface of a canopy. Such a solution can form the canopy using an orthogonal support structure (rotated 45 degrees from a conventional canopy structure, such as shown in FIG. 1) with a water-resistant covering. The natural contour of the covering, as created by use of the orthogonal support structure, can direct water towards the corners of the covering to a drainage system. The drainage system can then transport the water from the covering to an outlet location. One of ordinary skill recognizes that variations of the respective angles detailed herein as illustrative examples are able to be modified so long as water-run off is controlled to minimize the water pooling problems present in conventional canopies. Thus, in one embodiment, a five degree angle variation (from a 90 degree angle of a true orthogonal support structure) can be implemented in conjunction with the drainage system to an equivalent effect. In other contemplated embodiments, a ten, fifteen, twenty, and twenty five degree angle is able to be utilized. The greater the angle, additional structural elements for drainage direction may need to be provided, such as adding explicit channels or contours for water run-offs into the top portion of the canopy. For simplicity of expression, the disclosure generally refers to the support structure as orthogonal, which is a significant embodiment, while use of other angles as described herein are explicitly contemplated for other embodiments and should be considered within scope of the disclosure. The diagrams in the Figures illustrate the architecture, functionality, and operation of possible implementations of systems and/or methods according to various embodiments of the present invention.

Figure 2:
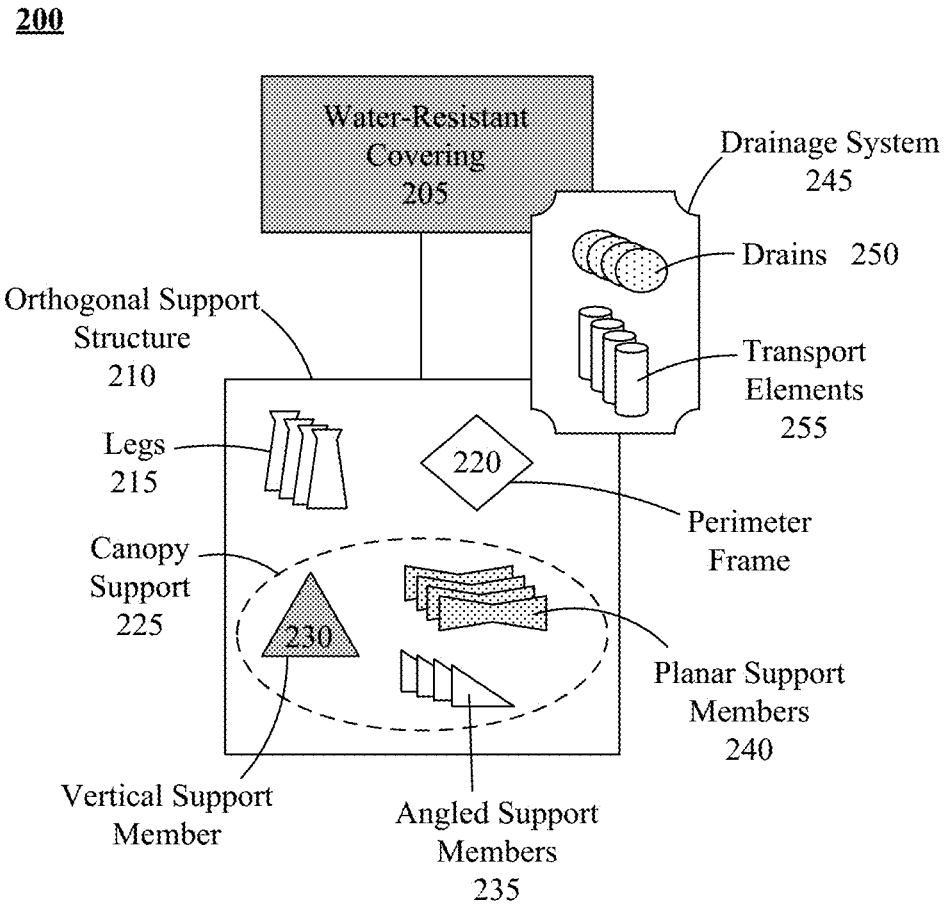
FIG. 2 is a block diagram presenting the components of a self-draining canopy in accordance with embodiments of the inventive arrangements disclosed herein.

FIG. 2 is a block diagram presenting the components of a self-draining canopy 200 in accordance with embodiments of the inventive arrangements disclosed herein. The self-draining canopy 200 can conform to the general definition of a canopy, as is understood in the Art. That is, the self-draining canopy 200 can be a covering 205 draped over a support structure 210 to provide shade and/or cover to people and/or things beneath.

The covering 205 of the self-draining canopy 200 can be of a size, shape, and materials that is similar to the variety of existing canopies and compatible with the size, shape, and bearing capacity of the support structure 210. It can be preferred that the covering 205 be of a water-resistant material as rain or water accumulation is of concern.

The covering 205 can be coupled to the support structure 210 using conventional means. The support structure 210 of the self-draining canopy 200 can orthogonally support the covering 205; a conventional support structure 115, as shown in FIG. 1, can provide diagonal support for the covering 110.

The orthogonal support structure 210 can include multiple legs 215, a perimeter frame 220, and canopy support 225. As is known in the Art, the legs 215 can be the vertical supports of the canopy 200 with the perimeter frame 220 laterally connecting the legs 215 to provide stability. For simplicity in discussion, the self-draining canopy 200 can have four legs 215 whose positions are the corners of a square in the horizontal plane. In various embodiments orthogonal structure 210 can vary in angle (from 90 degrees) by five degrees, ten degrees, fifteen degrees, twenty degrees, twenty five degrees and angles in between. Additional measures to aid in directing/controlling a flow of water are contemplated for angles that vary from the ninety degree baseline detailed herein.

It should be noted that the self-draining canopy 200 can utilize different quantities of legs 215 that are positioned to define other geometrical shapes in the horizontal plane without deviating from the spirit of the present invention.

The canopy support 225 can be the component of the self-draining canopy 200 that direct supports (i.e., comes into contact with) the covering 205. The canopy support 225 of the self-draining canopy 200 can include a vertical support member 230, angled support members 235, and planar support members 240. While similar components are used in the support structures of conventional canopies, the orientation of the non-vertical components 235 and 240 can be unique to the self-draining canopy 200.

As in conventional canopies, the vertical support member 230 can lift a center point of the covering 205 a predetermined height above the height established by the legs 215. The planar support members 240 can connect the bottom of the vertical support member 230 to the perimeter frame 220. Unlike similar components of conventional canopies, the planar support members 240 of the self-draining canopy 200 can be orthogonally connected to the perimeter frame 220 with respect to the horizontal plane. Though difficult to visualize, this key point can be graphically illustrated in subsequent Figures.

The angled support members 235 can be elements that comprise the hypotenuses of the right triangles that they form with the vertical support member 230 and planar support members 240. That is, the angled support members 235 can connect the top of the vertical support member 230 to the perimeter frame 220 at a point where the planar support members 240 connect to the perimeter frame 220. The covering 205 can directly rest upon the angled support members 235.

The orthogonal support of the canopy support 225 can allow the covering 205 to naturally direct rain/water down towards the corners. Conventional canopies with diagonal support of the covering 205 have support components or a natural contour that directs rain/water away from the corners towards the middle of the lateral face where the rain/water accumulates.

The components of the orthogonal support structure 210 can be connected to each other using suitable means and can utilize approaches and/or techniques taught by conventional canopies. For example, the collapsible diagonal support structure 115 of FIG. 1 can be modified to become a collapsible orthogonal support structure 210.

Near the corners where the rain/water is directed, the self-draining canopy 200 can have a drainage system 245. The drainage system 245 can include drains 250 and transport elements 255. The drain 250 can be an element that introduces one or more apertures in the covering 205 that allow rain/water to pass through to a connected transport element 255.

The transport element 255 can be the means that allows the rain/water to flow from the drain 250 to a designated outlet location. For example, the transport element 255 can be a piece of tubing connected to the drain 250 with the outlet location being the opposite end of the tubing. As another example, the transport element 255 can be integrated into the legs 215. That is, the legs 215 can have an interior channel that is connected to the drains 250.

It should be noted that the drainage system 245 can handle substances other than rain/water, including, but not limited to, sand, soil particulates, snow, ice particulates, sleet, dust, ash, liquid solutions, other non-hazardous or non-detrimental liquids, and combinations thereof.

Figure 3:
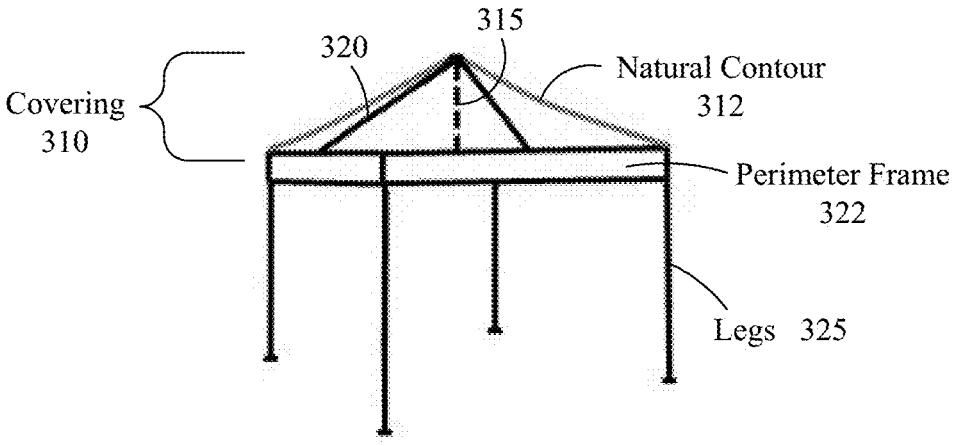
FIG. 3 depicts isometric views of an example embodiment of the self-draining canopy in accordance with embodiments of the inventive arrangements disclosed herein.
Figure 3:
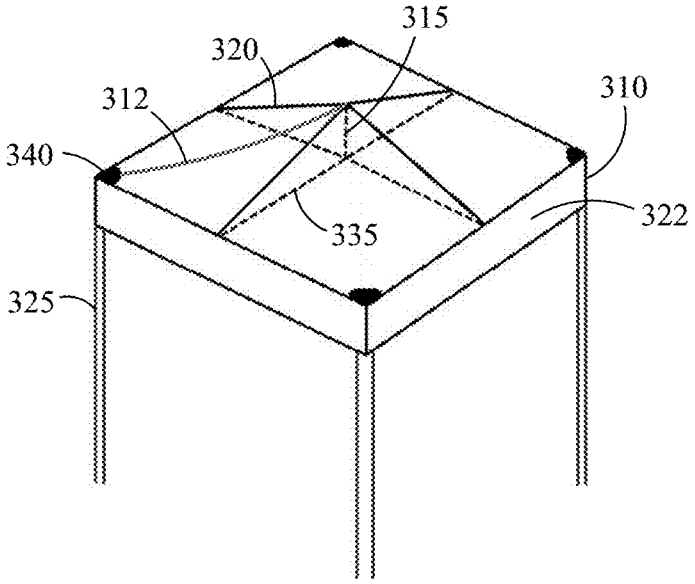

FIG. 3 depicts isometric views 305 and 330 of an example embodiment of the self-draining canopy in accordance with embodiments of the inventive arrangements disclosed herein. The example embodiment of the self-draining canopy illustrated in views 305 and 330 can represent a physical configuration of the components presented in FIG. 2.

The example of the self-draining canopy presented in views 305 and 330 can have an orthogonal support structure with a square base; the legs 325 can represent the corners of the square and the perimeter frame 322 can comprise the sides by laterally connecting the legs 325, as is typical of conventional canopies, see FIG. 1.

As shown in the isometric side view 305, the vertical support member 315 can lift the center point of the covering 310, also like conventional canopies. However, unlike conventional canopies, angled support members 320 can be connected to the midpoints of each side of the perimeter frame 322 and the top of the vertical support member 315. In a conventional canopy, the angled support members 320 can be omitted or connected to the top of the legs 325 to form a regular square pyramid.

The connection of the angled support members 320 to the perimeter frame 322 can be aligned with the planar support members 335, as shown in the top view 330. In the top view 330, the canopy support comprised of the vertical support member 315, angled support members 320, and planar support members 335 can be fully appreciated. Essentially, the vertical support member 315, angled support members 320, and planar support members 335 can represent two king post trusses that orthogonally intersect at the vertical support member 315.

Again, if such a configuration is used in a conventional canopy, the angled support members 320 and planar support members 335 can be positioned on the diagonal of the square base. It is this diagonal alignment that directs rain/water away from the corners of the base towards the middle of the side where it can accumulate and deform the canopy.

Since the position of the angled support members 320 are orthogonal and not diagonal, the expected pyramidal shape of the covering 310 can be thought of having been rotated 90° in the horizontal plane. That is, the edges of the pyramid, represented by the angled support members 320, do not align with the corners of the square base as in a square pyramid. Additionally, the lateral sides of the expected pyramidal shape cannot be completely flat due to the legs 325 pulling the midpoint of the base edge of the lateral side to the corner of the square base. As a result, the covering 310 can have a natural contour 312 on the diagonal that slopes downward towards the legs 325. The force of gravity can direct rain/water that falls on the covering 310 along the natural contour 312 towards the legs 325.

The purpose for having this diagonally-directed the natural contour 312 can be better seen in the isometric top view 330. Since rain/water is naturally directed towards the corners of the square base, the drainage system 340 can be positioned at the corners to remove the rain/water from the covering 310. Therefore, rain/water cannot accumulate on top of the covering 310 and deformation to the covering 310 by the weight of accumulated water can be prevented, which can extend the overall life of the self-draining canopy.

Figure 4:
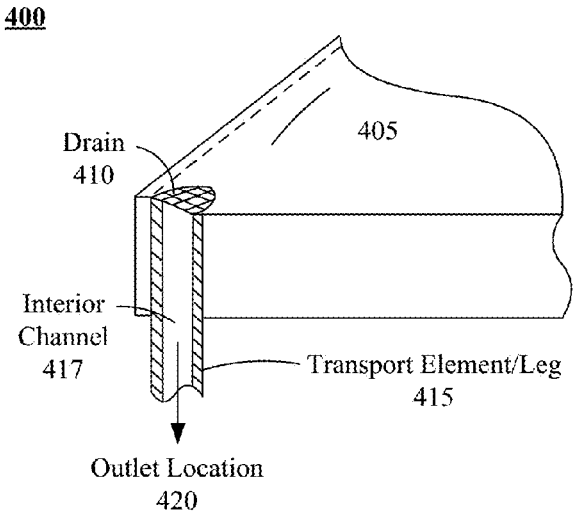
FIG. 4 presents enlarged illustrations of example embodiments of the drainage system of the self-draining canopy in accordance with embodiments of the inventive arrangements disclosed herein.
Figure 4:
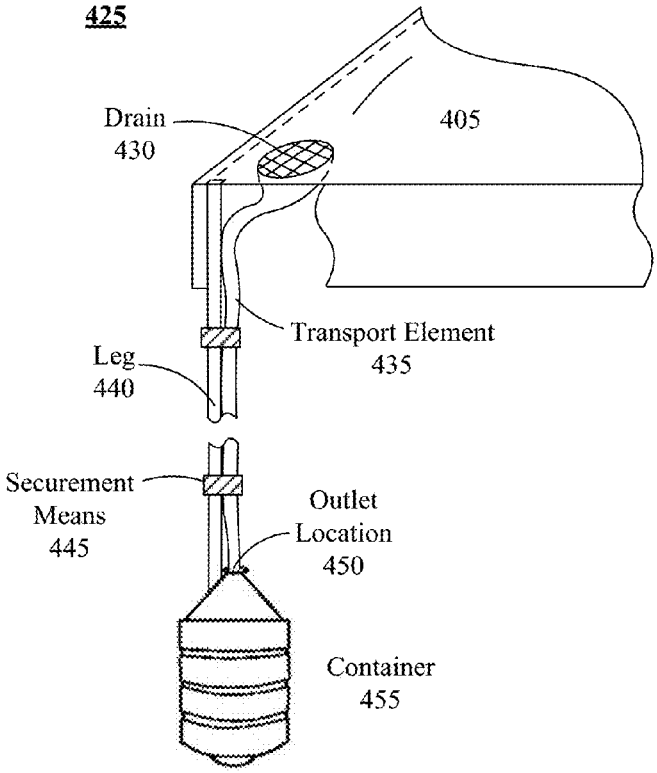

FIG. 4 presents enlarged illustrations 400 and 425 of example embodiments of the drainage system of the self-draining canopy in accordance with embodiments of the inventive arrangements disclosed herein. The example embodiments of the drainage system shown in illustrations 400 and 425 can be used within the context of the self-draining canopy 200 of FIG. 2 and the example embodiments of the self-draining canopy in FIG. 3.

Illustration 400 can show an embodiment of the drainage system that utilizes the leg of the orthogonal support structure as the transport element 415. In such an embodiment, the drain 410 can be installed in the covering 405 above or proximate to the leg 415. The drain 410 can be as simple as a hole made with a grommet (to keep the edges of the hole from fraying and/or tearing) and can include mesh or other means for preventing debris from passing into, and potentially blocking, the transport element 415.

The legs 415 of the orthogonal support structure can have an interior channel 417 for rain/water to flow through. Thus, the leg can act as the transport element 415 of the drainage system. This embodiment can be particularly suited for orthogonal support structures that are already designed to use hollow legs 415 (e.g., pipes and tubes).

The interior channel 417 can be of a diameter to provide a flow rate that reduces the possibility for the rain/water to back-up and accumulate on the covering 405. The interior channel 417 can run the entire height of the leg 415 with the rain/water exiting at the bottom of the leg and into the surrounding ground. In this case, the bottom end of the leg 415 can be the outlet location 420 of the transport element 415 for the rain/water.

Alternately, the outlet location 420 can exist at a point above the bottom of the leg. For example, a hole or spout can pierce through the sidewall of the leg 415 to the interior channel 417 three inches above the bottom of the leg 415. In such a configuration, it can be preferred that the outlet location 420 include additional means to further transport the rain/water away from the immediate area.

For example, a threaded hose connector can be integrated into the outlet location 420. A standard garden hose can then be connected to the outlet location 420 of the transport element 415 to empty the rain/water at a further distance, reducing the amount of rain/water discharged to the area around the self-draining canopy.

Illustration 425 can present a more complex implementation of the drainage system. In this embodiment, the drain 430 can be installed within the covering 405 near to the leg 440 of the orthogonal support structure. Since the leg 440 is not being used as a component of the drainage system, the drain 430 need not be positioned directly above or very close to the top of the leg 440. Additionally, the leg 440 need not be hollow as in illustration 400.

The transport element 435 can be a length of tubing that is attached to the drain 430 at one end and the open end that can act as the outlet location 450. As shown in illustration 425, the end of the transport element 435 that attaches to the drain 430 can require a gradation in size like a funnel. The amount of gradation can depend on the size of the drain 430.

The transport element 435 can be coupled to the leg 440 using one or more securement means 445 to prevent the transport element 435 from being inadvertently moved. The securement means 445 can be implemented in a variety of ways that are commensurate with the leg 440 and transport element 435. The securement means 445 should not exert undue force upon the transport element 435 that the transport element 435 is deformed or its functionality compromised.

In another embodiment, the securement means 445 can be integrated into the leg 440.

The transport element 435 can vary in length, but should be of a length that positions the outlet location 450 near to the ground. An advantage of this embodiment can be the ability to connect the outlet location 450 of the transport element 435 to a suitable container 455. The container 455 can be of any size or shape, providing it has an opening that allows the outlet location 450 to connect to or be placed within.

The use of a container 455 to collect the rain/water from the drainage system can have many benefits. Firstly, the saturation of the ground in the immediate area of the self-draining canopy can be reduced because the rain/water is collected and not discharged. The container 455 can be removed and remotely emptied when full.

Secondly, the collected rain/water can be used. In a camping setting, the collected rain can be treated to become potable drinking water. In a backyard setting, the collected rain can be used to water plants and trees, reducing the amount of water paid for to perform that task.

What is claimed is:

1. A self-draining canopy comprising:

a covering made from a water-resistant material having a substantially quadrilateral shape in a horizontal plane, a topmost surface of the covering being substantially exposed to an environment;

a support structure comprising a canopy support and at least four vertical legs, the canopy support being in direct contact with the covering that is stretched over the canopy support, wherein the canopy support comprises a perimeter frame, wherein the perimeter frame is approximately parallel to the horizontal plane, wherein approximately parallel is an angle within ten degrees of being parallel, wherein the canopy support comprises a vertical support member, wherein the vertical support member supports a portion of a surface of the covering to lift this portion of the covering above each of the edges of the covering, said edges of the covering being edges of the substantially quadrilateral shape that are each secured to the perimeter frame, wherein the topmost surface of the canopy as secured to the perimeter frame is shaped as at least four triangular planes, each of the four triangular planes having one corner at an apex proximate to the vertical support member and having two other corners each being proximate to a respective one of the vertical legs, wherein the vertical legs vertically support the perimeter frame at predetermined heights above a ground surface representing the horizontal plane, wherein each of said vertical legs is approximately perpendicular to the horizontal plane, wherein approximately perpendicular is an angle within ten degrees of a right angle, wherein the covering comprises at least one drain, the at least one drain being an aperture through a surface of the covering, wherein the canopy support is a collapsible temporary structure providing protection from sun and rain during outdoor activities; and a drainage system that transports environmental substances from the topmost surface to at least one outlet location, wherein transportation of the environmental substances through the drainage system is provided by a force of gravity, wherein said drainage system prevents an accumulation of environmental substances on the topmost surface of the canopy and prevents a deformation of the canopy due to such accumulations, wherein the drainage system comprises at least one conduit extending from the at least one drain to the at least one outlet location, wherein at least a portion of each conduit runs vertically parallel to one of the vertical legs, wherein the at least a portion of each conduit is integrated within or supported by the respective one of the vertical legs.

2. The canopy of claim 1, wherein the at least one drain comprises four drains, one corresponding to each corner of the substantially quadrilateral shape.

3. The canopy of claim 1, wherein each conduit of the at least one conduit of the drainage system is an interior channel of one of the vertical legs.

4. The canopy of claim 1, wherein each conduit of the at least one conduit of the drainage system comprises a length of tubing that is secured to one of the vertical legs.

5. The canopy of claim 1, wherein the at least one drain further comprises:

a filter element that prevents debris from entering the respective conduit.

6. The canopy of claim 1, wherein the environmental substances comprise at least one of water, sand, soil particulates, snow, ice particulates, sleet, dust, ash, and combinations thereof.

7. The canopy of claim 1, further comprising:

a container connected to the outlet location of the drainage system, wherein said container is suitable for holding the environmental substances.

8. The canopy of claim 1, further comprising:

at least one tube connected to the at least one outlet location of the drainage system to transport the environmental substances a distance away from the canopy.

9. The canopy of claim 1, further comprising:

four planar support members intersecting at the vertical support member, wherein each of the four planar support members is a triangular shaped plane having one corner at an edge of the quadrilateral shape midway between the respective corners of the quadrilateral shape, having another corner at the apex, and having another corner at a bottom of the vertical support member.

10. A drainage system comprising:

a plurality of drainage apparatuses to transport environmental substances from a topmost surface of a covering of a canopy to an outlet location, wherein transportation of the environmental substances is provided by a force of gravity in conjunction with a natural contour of the canopy and of the covering that automatically directs environmental substances deposited upon the topmost surface toward the plurality of drainage apparatuses, wherein each drainage apparatus prevents an accumulation of the environmental substances on the topmost surface of the covering and a prevents a deformation of the covering and of the canopy due to such accumulations, wherein the covering is made from a water-resistant material having a substantially quadrilateral shape in a horizontal plane, wherein the topmost surface of the covering is substantially exposed to an environment, wherein a canopy support is in direct contact with the covering that is stretched over the canopy support, wherein the canopy support comprises a perimeter frame, wherein the perimeter frame is approximately parallel to the horizontal plane, wherein approximately parallel is an angle within ten degrees of being parallel, wherein the canopy support comprises a vertical support member, wherein the vertical support member supports a portion of a surface of the covering to lift this portion of the covering above each of the edges of the covering, said edges of the covering being edges of the substantially quadrilateral shape that are each secured to the perimeter frame, wherein vertical legs secured to the canopy support vertically support the perimeter frame at predetermined heights above a ground surface representing the horizontal plane, wherein each of the vertical legs is approximately perpendicular to the horizontal plane, wherein approximately perpendicular is an angle within ten degrees of a right angle, wherein the canopy support is a collapsible temporary structure providing protection from sun and rain during outdoor activities, each drainage apparatus further comprising:

a drain that establishes at least one aperture through a surface of the covering, wherein the at least one aperture is of a size to allow passage of the environmental substances; and a transport element connected to the drain that permits the environmental substances to move from the drain to the outlet location through an enclosed space, wherein at least a portion of the transport element is integrated within or supported by a respective one of the vertical legs.

11. The drainage system of claim 10, wherein the drain further comprises:

a filter element covering the at least one aperture that prevents debris from entering the transport element.

12. The drainage system of claim 10, wherein the transport element is a tube connected to the outlet location to transport the environmental substances a distance away from the canopy.

13. The drainage system of claim 10, further comprising:

a container connected to the outlet location of the drainage system, wherein said container is suitable for holding the environmental substances.

14. The drainage system of claim 10, wherein the transport element is is an interior channel of one of the vertical legs.

15. The drainage system of claim 10, wherein the transport element is a length of tubing that is secured to one of the vertical legs.

16. The drainage system of claim 10, wherein the environmental substances comprise at least one of water, sand, soil particulates, snow, ice particulates, sleet, dust, ash, and combinations thereof.

17. A method of installing a drainage system for a canopy, comprising steps of:

supporting of a canopy with an orthogonal support structure, the orthogonal support structure including multiple vertical legs and non-vertical elements, wherein the non-vertical elements of the orthogonal support structure that the canopy rests upon are positioned substantially orthogonally within a horizontal plane, wherein at least a portion of the canopy is lifted above edges of the canopy to induct a natural contour of the canopy;

installing the canopy with a drainage system, the drainage system includes at least one drain, the drain is an aperture through a top surface of the canopy, the drain is located near a corner of the canopy; wherein the drainage system includes a transport element connected to the at least one drain; the transport element extends from the at least one drain to at least one outlet location, and at least a portion of the transport element is integrated within or supported by a respective one of vertical legs;

upon exposure of the canopy to rain, directing rain that has fallen on a top surface of the canopy toward the drainage system installed near a corner of the canopy using the natural contour of the canopy in conjunction with a force of gravity, wherein said natural contour of the canopy is induced by the orthogonal support structure; and transporting of the rain from the top surface of the canopy to the outlet location by the transporting element of the drainage system, wherein the outlet location is proximate to ground level, wherein the drainage system prevents an accumulation of the rain on the top surface of the canopy and a deformation of the canopy due to a weight of such accumulations.

18. The method of claim 17, wherein transporting of the rain further comprises:

filtering the rain as it passes through the at least one aperture, wherein debris over a predetermined size is prevented from entering the drainage system.

19. The method of claim 17, wherein transporting of the rain further comprises:

connecting a container to the outlet location, wherein the rain is collected in said container.

20. The method of claim 17, wherein transporting of the rain further comprises:

connecting the transporting element which is a tube or a hose to the outlet location to change where the rain exits the drainage system.

* * * * *